US005797436A

United States Patent [19]

Phallen et al.

[11] Patent Number: 5,797,436

[45] Date of Patent: Aug. 25, 1998

[54] LIQUID FILLING MACHINE TECHNICAL FIELD

[75] Inventors: Iver J. Phallen, Youngstown; Richard J. Jezuit, Lancaster; Steven D. Payne, Lockport, all of N.Y.

[73] Assignee: Oden Corporation, Buffalo, N.Y.

[21] Appl. No.: 494,918

[22] Filed: Jun. 26, 1995

[51] Int. Cl.[6] ..... B65B 31/00

[52] U.S. Cl. ..... 141/82; 141/93; 141/129; 53/127; 53/440

[58] Field of Search ..... 141/82, 92, 93, 141/97, 129; 53/127, 440; 52/786.1

[56] References Cited

U.S. PATENT DOCUMENTS

| | | | |
|---|---|---|---|
| 2,209,315 | 7/1940 | Ball | 53/440 X |
| 2,549,216 | 4/1951 | Martin . | |
| 2,685,520 | 8/1954 | Martin | 53/127 X |
| 3,058,276 | 10/1962 | Palma | 141/92 X |
| 3,105,335 | 10/1963 | Hickey | 53/127 |
| 4,057,945 | 11/1977 | Kessler | 52/786.13 |
| 4,142,561 | 3/1979 | Bennett et al. | 141/82 |
| 4,417,607 | 11/1983 | Scholle et al. | 141/92 X |
| 4,674,267 | 6/1987 | Szemplenski et al. | 141/440 X |
| 5,209,273 | 5/1993 | Giuffredi et al. | 141/93 X |
| 5,313,761 | 5/1994 | Leopold | 52/786.1 |
| 5,466,534 | 11/1995 | Newby | 52/786.1 |

*Primary Examiner*—J. Casimer Jacyna
*Attorney, Agent, or Firm*—John C. Thompson

[57] ABSTRACT

A filling machine (10) for filling into containers (30), by volume, weight, or level, of products requiring maintenance of a specified temperature. The filling machine includes a product reservoir (14), a filling nozzle (16), a pump (22) and suitable tubes (26, 28) for controlling the flow of product from the reservoir to the nozzle. The above parts are disposed within a double walled enclosure (62). A conveyor (44) having an upper flight (44.2) which supports containers (30) to be filled via the filling nozzle enters and exits the enclosure. A heater (138) is located outside of the enclosure and is connected to the enclosure through an insulated air duct (130) so that forced hot air may be used for heating the enclosure. A heat sensor (158) is provided within the enclosure for controlling the flow of air into the enclosure and also for regulating the output of the heater. The enclosure is provided with two aligned doors (96, 98), and when these doors are opened a blow down cycle is initiated.

9 Claims, 7 Drawing Sheets

10
32
36
54
58
34
30
52
130
12.1
98
74
118.4
110
128
112
14
96
118.2
100.4
176
7
7
5
5
8
8
100.1
100.3
12.1
12
18
76
6
6
158
16
100.2
74
30
58
62

LIQUID FILLING MACHINE TECHNICAL FIELD

BACKGROUND OF THE INVENTION

In the container filling industries, liquid filling machines are sometimes used to fill containers with products which require heating to elevated temperatures above ambient in order to be successfully placed into the selected container. In many cases the product must be heated in order to allow the filling machine to successfully move the product through the filling apparatus itself.

In the past, when these requirements have been encountered, numerous solutions have been attempted. These have included heating means such as surrounding the complete filling apparatus with an insulated and heated room or tracing the filling apparatus with suitable heating elements in order to add heat energy to the system. In another case, radiant heat lamps are placed in close proximity to the filling mechanism in order to raise the temperature of the mechanism. In still another case known in the prior art (U.S. Pat. No. 4,142,561), a cabinet is placed around the filling apparatus and heated by injection of heated air from a blower and heater located in the base of the machine. In this arrangement, the filling tubes, used to deliver heated product into the container packages, are specified to periodically be lowered in such a way that they leave the heated enclosure and are positioned about or in the container packages. The container packages are suitably disposed to receive the filling tubes by being positioned on a conveyor. The conveyor is below and outside of the heated enclosure.

This last method offers substantial improvements over the previously cited means of temperature control, but is never-the-less burdened with numerous shortcomings. Among these are that the heated cabinets of known type are of a simple construction with loose fitting single panels. These single panels, generally of transparent plastic, allow substantial heat loss from the area they enclose by their very nature. Further, much hot air is lost by substantial leakage about and around the lossely fitted dpanels. Taken together, these means cause substantial heat loss and severely limit the maximum temperature above ambient to which the enclosure can be elevated, and result in very poor energy efficiency.

Another limitation of the previous heated enclosure designs concerns the variations of relative temperatures within the heated enclosure. Because of the leaky design and the variable placement of apparatus within the heated area and the well recognized property of hot air to rise, the temperature within the heated area can vary by many degrees centigrade from bottom to top of the heated area and within the heated enclosure. This temperature variance is frequently too great and too random as to be allowable and useful in controlling the filling characteristics of many products.

Another problem associated with heated enclosure liquid fillers of previously known types concerns the specified placement of the product container conveyor outside of the heated enclosure and the specified movement of the filling tubes to an area outside of the heated enclosure and above the conveyor during filling. Taken separately and together, this arrangement requires that the filling nozzles be outside of the heated area for a substantial period of time during the actual fluid dispensing period. This period would commonly be of a duration of one to ten seconds, and can be of adequate time for product to thicken or solidify on the filling tubes, particularly at the very tips thereof, and particularly when the product is only slightly elevated above its solidification temperature as is commonly and sensibly the practice.

A further limitation of known heated enclosure liquid fillers concerns operation of such a machine in a hazardous or flammable environment. It is well understood that many products requiring heating for filling give off vapors and gases which can be hazardous or flammable. The use of a motor and blower in conjunction with electrically controlled heaters contained within the machine, as is the case with the previously known types, therefore creates a hazardous and unsafe condition and is thus not allowed.

Still another limitation associated with the single panel construction of heated filling machine enclosures of previous type concerns machine operator safety. Because the enclosure's panels are loose fitting and free moving, it is possible for a person to open the enclosure while the air within is at elevated temperature. This can result in a large discharge or release of heated air onto and about the operator. When such air is at or above about 60° centigrade the operator can experience pain and injury from such exposure. Even when a panel is not opened by an operator, a single layer panel which is touched by an operator when the panel is at or about 60° centigrade will cause pain. At a temperature of about 66° centigrade, skin contact with a panel can cause burns.

Another problem associated with heated enclosure liquid fillers of known type is that the containers into which the heated product is to be dispensed are at ambient temperature. This frequently causes uneven and accelerated cooling and solidification of many heated products. This, in turn, can cause undesirable distortions of the container or product body or even rapid cooling induced separation of the product from the containers wall, or irregular and random changes in product color or texture, or surface appearance.

OBJECTS AND SUMMARY OF THE INVENTION

It is a primary object of the present invention to overcome the numerous disadvantages of heated enclosure liquid fillers of the prior art as set forth above. More specifically, it is the primary object of the present invention to provide a liquid filling machine in which the container conveyor enters a temperature controlled heated enclosure on one side and passes through it and exits on the opposite side, the filling nozzle(s) being within the heated enclosure so that the filling nozzles need never pass out of or leave the temperature controlled enclosure which has tightly and permanently sealed panels free of air leaks and which has a double wall construction with a trapped air space in between the panels, and to provide a heated enclosure which has air jets of heated air located within.

It is a further object of this invention to provide a temperature controlled filling machine which has the forced air heat source located sufficiently remotely from the machine to allow operation in hazardous environments; which has a locking mechanism to prevent entry into the enclosure while its temperature is above a specified level; which provides for a period of forced air circulation at ambient temperature prior to allowing cabinet entry; and which provides for the heating of containers within the cabinet prior to, or during filling.

The present invention relates to a unique and novel means whereby the container conveyor passes through the heated enclosure. By this unique means, the actual dosing procedure, by whatever means and involving one or more filling nozzles is carried out entirely within the temperature controlled cabinet. Because the nozzle tubes never leave the cabinet this, in turn, ensures that the filling nozzles cannot be reduced in temperature during filling which prevents the build-up of solidified or thickened product on or about these nozzles. This aspect of the present invention is particularly important in allowing only a slight elevation of the product and apparatus temperature above that required for the particular case. This allows successful operation on products where overheating is detrimental to product properties or characteristics and further offers much reduced heating costs by reducing the level of heating required.

The present invention further provides for a sealed cabinet in which the heated air exits essentially only from the apertures through which the conveyor enters and exits, said apertures being of the smallest practical dimensions allowable, and said apertures being adjustable as necessary from time to time to allow minimum dimensioning as the specific filling case will allow. This approach allows a predictable and controllable heated enclosure environment in which temperature controlled air loss is held to the absolute minimum and in which it is possible to regulate temperatures in a predictable way. In the present invention, temperature control is actively controlled within the enclosure by use of relatively high velocity temperature controlled air jets. This novel method, in which a main flow of air into the cabinet from a remote source is sub-divided in such a way that separate flows can be directed as necessary to achieve desired temperatures within particular sections or regions of the enclosure. It is particularly important to note that this allows equilibration of temperature within the cabinet regardless of dimensions or inclusions of apparatus within; and equally important in other cases, allows the establishment of separate temperatures in various sections or regions of the cabinet as desired. This capability is particularly important in that additional thermal energy can be precisely delivered onto or about very specific sections of apparatus. Thus, for example, additional heating can be carried out on a device which is particularly prone to accelerated heat loss, as, for example, when a portion of the filling mechanism is fastened to a portion of the machine frame causing accelerated heat loss therefrom.

The ability to direct heat energy variably and separately is particularly crucial when a filling machine is operated at comparatively high elevated temperatures about ambient, as for example up to 125° centigrade. As will presently be explained, operation at these relatively extreme temperatures requires this novel heat control method to be successful.

Still another object of this invention is to allow its operation with flammable products or in hazardous areas. It is well understood and recognized that electrically powered heaters and blowers are not safe in such areas. Thus, this invention provides for a completely separate and isolated heating module which contains all means of heating and blowing air. The air is then novelly directed to the heated filling machine enclosure using a flexible duct of double wall construction with insulation placed between the flexible duct walls, said ducting being constructed of suitable high temperature materials. A double wall duct construction allows the duct to be placed and handled safely even when high temperature air is passing through it.

By remote placement of the heating elements, the air forced into the system can be of known quality and can be assured of being free of any hazardous vapors. Furthermore, all sources of ignition associated with the heating have been removed, the distance of remoting is variable and, in practical terms, substantially unlimited, but in any event is easily greater than twenty-five feet. The heater mechanism in the present invention is controlled by electronic means, with the temperature sensing being accomplished within the cabinet and the level being safely sent to the heater apparatus using intrinsically safe barriers of suitable type.

Another novel aspect of the current invention is that in addition to controlling the temperature of the air being sent to the filling machine, the volume of air is controlled as well. This is a fundamentally important advancement in the state-of-the-air in that it allows a relatively high volume of air at relatively high temperature to be delivered early on in the heat-up process, but then allows a much reduced volume of air at precisely the required final temperature to be delivered to the cabinet, in such a way as to reduce the total thermal energy requirements to the absolute minimum required to maintain a desired temperature. This improvement in efficiency is substantial and can lower energy costs in such a system by a very substantial amount. This efficiency of operation is particularly important in operating a cabinet enclosed filling machine at temperatures about 100° centigrade, where machines of previously known type cannot reach or be maintained in temperature.

Another very important object of the present invention is the unique double wall construction utilized to fashion the heated enclosure. By utilizing an inner panel, frequently of tempered glass, to allow exposure to temperatures well above those allowable with most plastics, said panel being sealed to its supporting frame by common glazing materials, a first heat barrier is established. By constructing an outer panel support frame and affixing and sealing to it an outer panel of metal or plastic or glass, an air barrier of trapped air of suitable dimensions between panels is established. Thus, this air space serves as a second co-existing heat barrier. The outer panel, unto itself, serves as a third co-existing heat barrier. Taken separately, but most crucially as a three barrier structure, this novel arrangement substantially reduces the rate of heat energy loss from the cabinet. This, in turn, greatly reduces the required heat energy to maintain a given temperature above ambient, and this, in turn, greatly lowers the operating costs associated with this machine. These efficiencies and savings are particularly important when the cabinet is operated at particularly high temperatures, since the greater the temperature elevation, the greater the rate of heat loss. It is also important to understand that this reduced rate of heat loss method allows the system to reach much higher operating temperatures than would otherwise be the case, and to do so with a remote heater module of much less wattage capability than would otherwise be the case.

Another novel aspect of the three barrier temperature enclosure of the present invention is its operator safety improvements. Because of the previously described construction of the heated cabinet, the outer wall is only relatively warm to the touch when exposed skin is placed against it. This is true, even for a cabinet operating with an internal temperature of 120° centigrade. Thus, the risk of burns or pain associated with the operation of heated filling machines of previously known types is essentially eliminated.

A further novel aspect of the present invention is that the afore-described heated enclosure is equipped with access doors which are hinged and fitted with a locking mechanism, and are substantially sealed when closed. The locking mechanism is pneumatically operated and thus safe for use even in hazardous environments. In operation, when the heated cabinet reaches a temperature judged in the particular case to be unsafe for operating personnel, the pneumatic lock engages, effectively preventing entry into the interior of the cabinet and thus substantially reducing the risks of injury or pain to said operators. Likewise, when the temperature of the enclosure decends to one below which entry in the interior of the cabinet is safe, the locking mechanism disengages. This apparatus is controlled by sensing the temperature within the cabinet using the same sensor which controls the remotely located heating apparatus or by separate sensor means where further safety enhancement is desired.

Still a further novel feature of the present invention is the use of an intrinsically safe cabinet door interlock switch which prevents the operation of the remote heater whenever the outer wall door cabinet is in an open condition.

A further novel aspect of this invention is the use of a blow-down or cooling sequence when cabinet entry is desired. By intrinsically safe electronic means, the operator may cause the remotely located heating apparatus to be turned off, but the air blower mechanism to remain on at high flow rate. This way, hot air is rapidly forced from the cabinet, greatly reducing the time required to allow safe entry thereto.

An additional novel feature of this invention is the ability of the machine to place product containers completely within the boundaries of the heated enclosure, prior to and during filling. This is possible because of the novel feature of this invention wherein the product container conveyor runs completely though the heated chamber. Because this is so, the containers have a definite residence time within the heated area. Because this is the case, the containers can be heated to some degree above the ambient temperature, particularly on the immediate outer surfaces thereof. This unique feature can have the most beneficial role of allowing less precipitous heat loss from the quantity of product being placed into the container. Thus, the problems associated with too rapid cool down of some products, such as crystallization, changes in color, texture, clarity or chemical changes or separation of various constituents of the product are reduced or avoided.

The foregoing objects and advantage of this invention will become more apparent to one having ordinary skill in the art after a consideration of the following detailed description taken in conjunction with the accompanying drawings in which a preferred form of this invention is illustrated.

DETAILED DESCRIPTION

Figure 1:
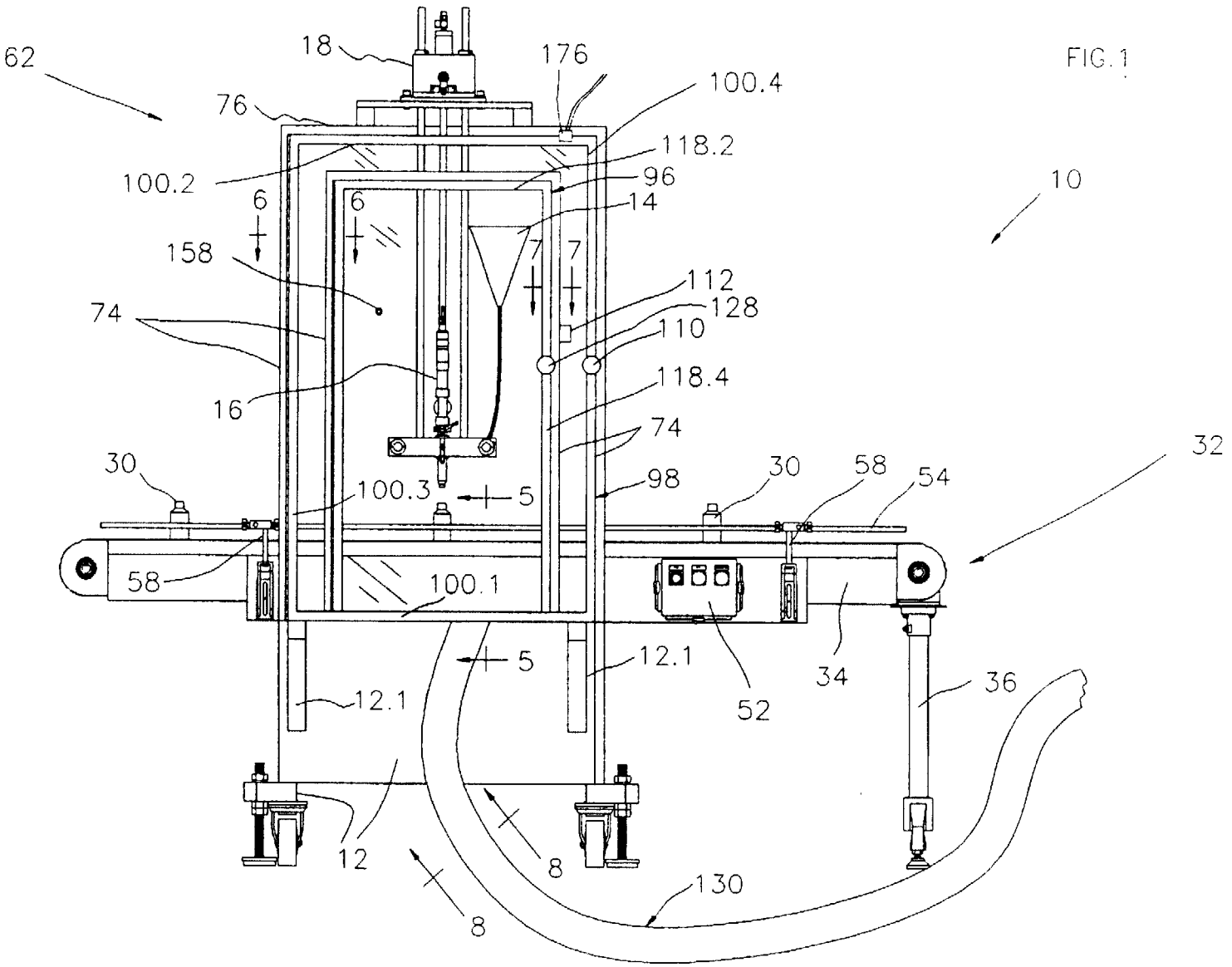
FIG. 1 is a front elevational view of the liquid filling machine of this invention.
Figure 2:
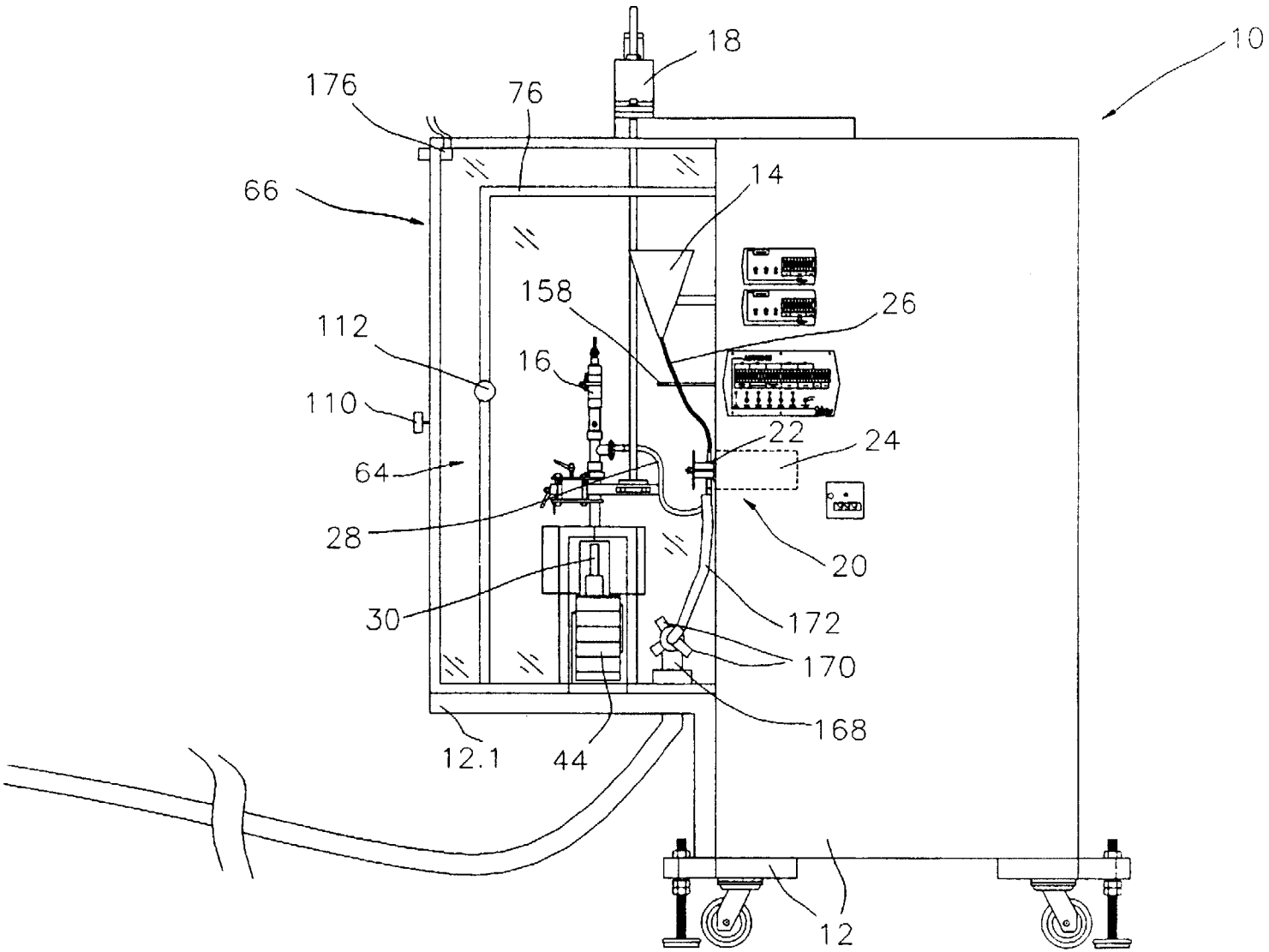
FIGS. 2 and 3 are side elevation and top views of the liquid filling machine shown in FIG. 1, the upper conveyor flight being omitted in FIG. 3 for purposes of clarity.
Figure 3:
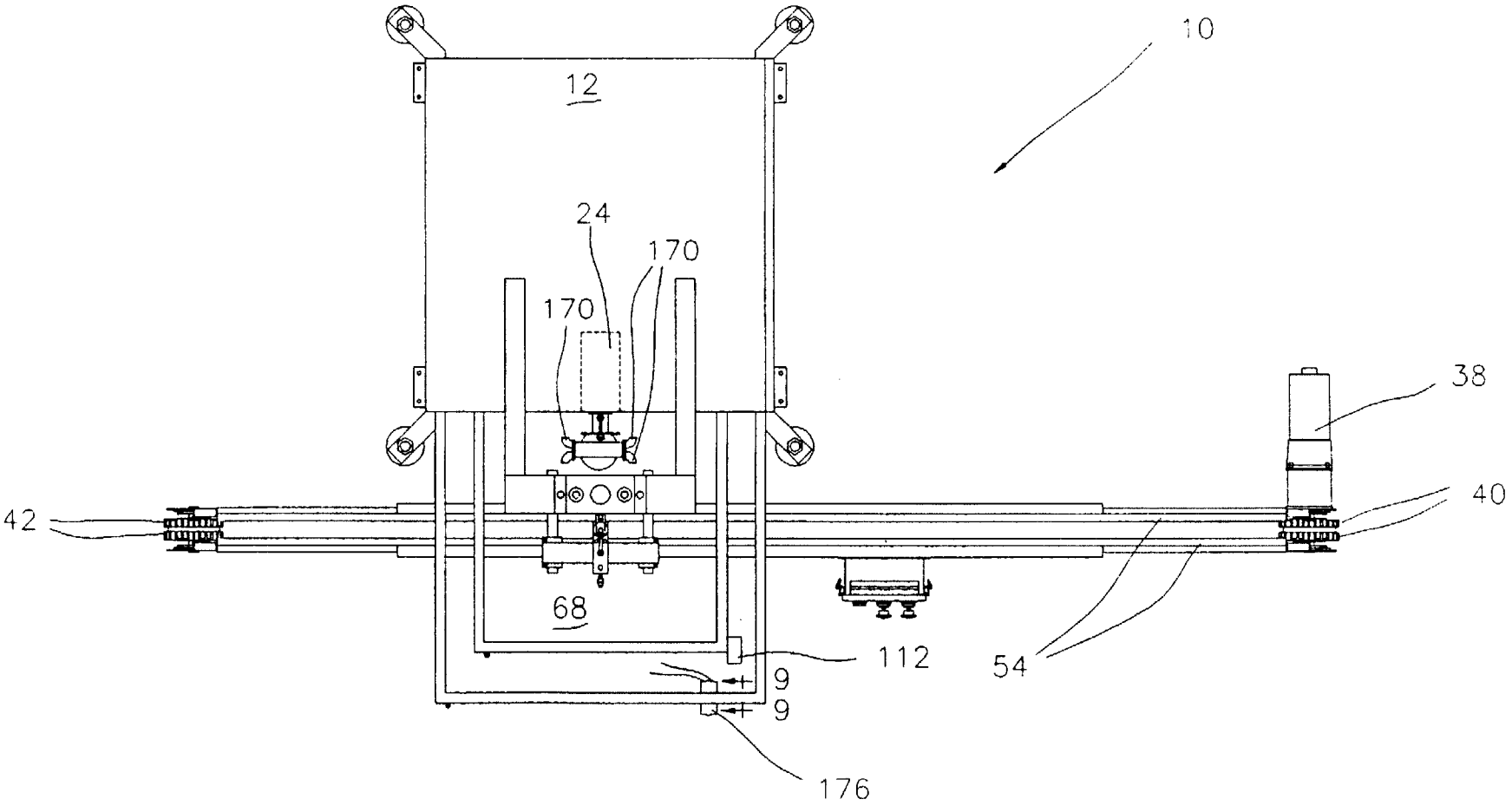

With reference initially to FIGS. 1, 2 and 3, the liquid filling machine of this invention is indicated generally at 10. The machine includes a frame and housing 12 (FIG. 1) upon which the major components of this invention are mounted. Thus, a product reservoir 14 is carried by the housing 12 as well as a filling nozzle 16. The filling nozzle may be mounted in a stationary manner, but it is preferably interconnected with a diving mechanism 18 carried on the top of the housing, the diving mechanism permitting the filling nozzle to enter into the top of the container to be filled. The product reservoir 14 and filling nozzle 16 are interconnected with each other by flow control means indicated generally at 20 in FIG. 2. Various different types of flow control means can be utilized and in the very simplest form, it may be simply an on-off valve which permits the flow from the reservoir to the filling nozzle when open, and which will prevent the flow when closed. In the embodiment illustrated in this invention though, the flow control means is a pump 22 which is driven by a pump motor 24. While the pump 22 may be connected directly to the output shaft of the motor 24, in the embodiment illustrated it is magnetically coupled to the output of the motor 24. Thus, with reference to FIG. 2, it can be seen that during the operation of the pump 22, product to be filled will flow from the reservoir 14 through a first product conveying tube 26 to the pump 22 and from the pump 22 through a second product conveying tube 28 to the filling nozzle 16.

Figure 5:
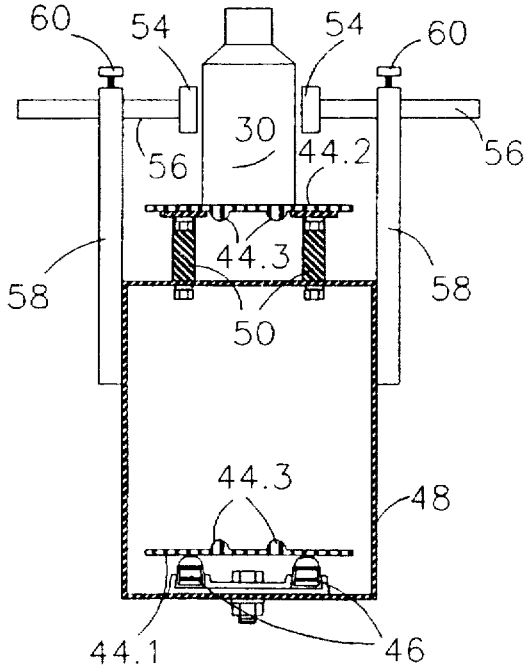
FIG. 5 is a sectional view taken generally along the line 5—5 in FIG. 1.

In order to present suitable containers 30 which are to be filled by the liquid filling machine of this invention, a conveyor 32 is provided, the conveyor including a subframe 34 which may be supported by an auxiliary support 36, a conveyor motor 38, drive sprockets 40, and driven sprockets 42. Extending between the sprockets 40 and 42 is a conveyor chain 44. The conveyor chain has a lower flight (or return flight) 44.1 which is supported in part by conveyor return rails 46 (FIG. 5), the conveyor return rails in turn being mounted within a conveyor housing 48 supported by brackets 12.1 on the front of the frame housing 12. Mounted on the upper surface of the conveyor housing 48 are conveyor standoffs 50. The conveyor standoffs 50 in turn support the upper flight 44.2 of the conveyor chain. As can be seen from FIG. 5, each of the cross links of the conveyor chain are provided with suitable lugs 44.3 which are engaged by the drive sprockets 40 for the purpose of driving the chain. The operation of the conveyor motor may be initiated from an operator control 52. In order to provide the container with lateral stability in the area where it is being filled, front and rear stabilizer rails 54 are provided. Each of the front and rear stabilizer rails are in turn mounted on an adjustable bar 56 which is in turn adjustably connected to a stabilizer support bracket via a threaded fastener 60 of any conventional design.

To a large extent, the filling machine so far described is of a type well known in the prior art. As pointed out above, the disadvantage of this form of filling machine, so far described, is in the handling of product which is either solid or highly viscous at room temperature. Accordingly, it is a feature of this invention to provide an enclosure to totally enclose the reservoir 14, filling nozzle 16, and the container while it is in the environment of the filling nozzle. To this end, an enclosure, indicated generally at 62, is provided. In the preferred design of this invention, the enclosure is double walled, having essentially one enclosure within another. The inner and outer enclosures can be considered as cabinets, the back of the cabinets being part of the housing 12. The brackets 12.1 additionally support an inner enclosure indicated generally at 64 in FIG. 2 and an outer enclosure indicated generally at 66. The bottom of each of the enclosures is formed of a steel plate 68 supported by the brackets 12.1. Supported upon the steel plate along the sides thereof are lower horizontal frame members for each of the enclosures, each of the lower side frame members having a generally inverted U-shaped portion as can best be appreciated from an inspection of FIGS. 2 and 4. Thus, the right horizontal frame member 70 for the outer enclosure has an inner horizontal lower side portion 70.1, an intermediate inverted U-shaped portion 70.2, and an outer horizontal lower side frame portion 70.3. It should be appreciated that the left horizontal lower side frame member 70 for the outer enclosure will have an identical structure to that of the right horizontal lower side frame member 70 shown in FIG. 4. In addition, the right and left horizontal lower side frame members 70 for the inner enclosure 64 will be essentially the same as those for the outer enclosure except that each will have a shorter outer portion 70.3. The rear end of each of the horizontal lower side frame members 70 will be connected to a rear vertical frame member 72 which abuts in air tight contact the front wall of the housing 12. Secured to the outer end of the outer portion 70.3 of each of the horizontal lower side frame members 70 is a front vertical frame member 74. The upper end of each of the rear and front vertical frame members in turn supports a horizontal upper side frame member 76. As can be seen from the above, the side of each enclosure is framed by frames 70, 72, 74 and 76. The inner enclosure 64 has side walls formed of a sheet of tempered glass 78, the glass being held in place within the frame 70, 72, 74, 76 by a glazing strip 80 and a silicone seal 82. The outer enclosure is provided with side walls formed of a clear polycarbonate, each sheet of polycarbonate 84 being secured in place by a glazing strips 86 and 88.

Figure 4:
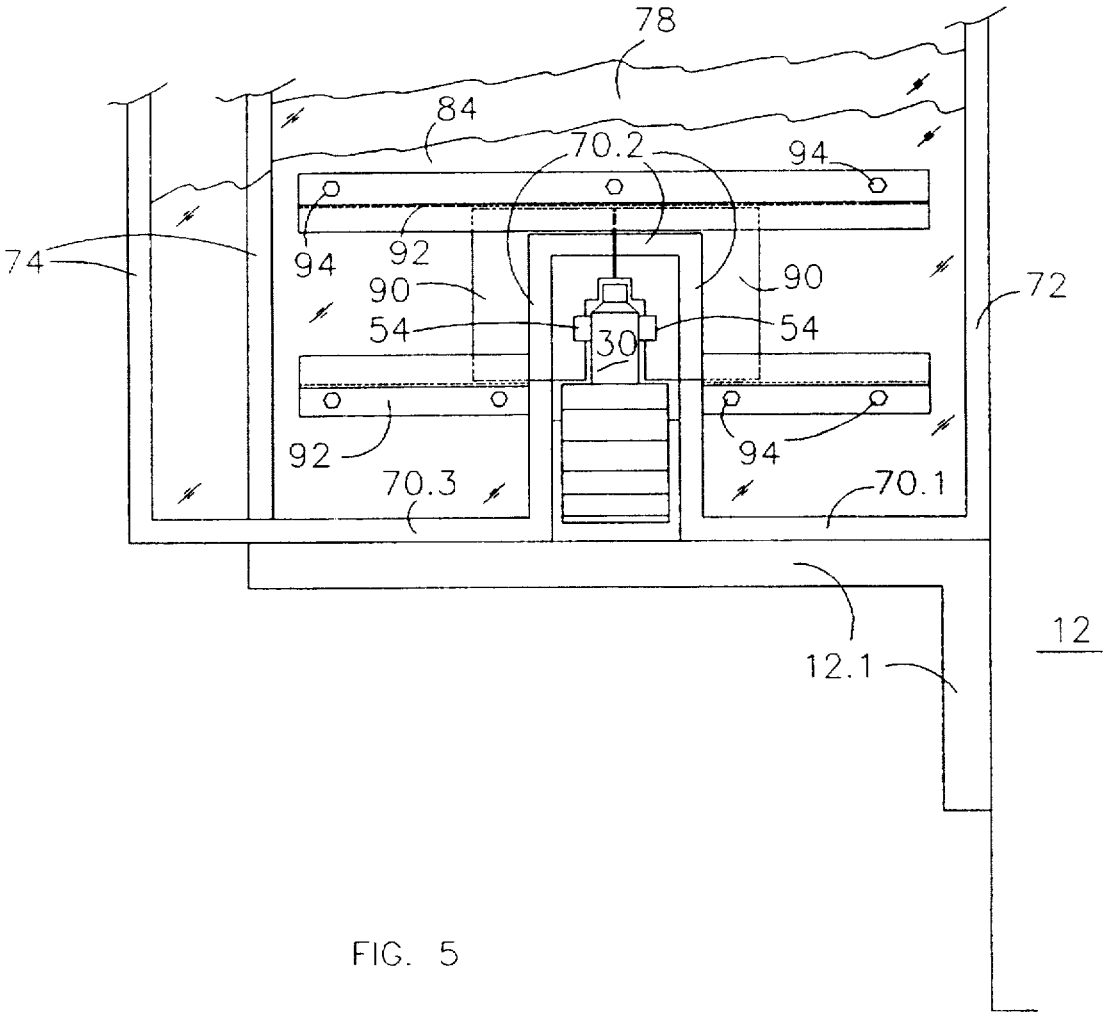
FIG. 4 is an enlarged side view of a portion of the liquid filling machine shown in FIG. 2.

It can be seen from FIGS. 1, 2 and 4 that the conveyor housing 48 extends entirely through the outer and inner enclosures 64, 66 respectively. The conveyor housing is sealed against the sides of the for the inner enclosure 64 shaped members 70.2. However, there is an opening above the conveyor housing in the sides for the entry of the upper flight of the conveyor and the containers carried thereon. As the inner enclosure will be provided with forced hot air for heating purposes, it is desired to minimize the loss of hot air from the inner enclosure. To this end, moveable aperture plates 90 are provided, each aperture plate being provided with a suitable cutout, so that when they are in abutting positions as shown in FIG. 4, they will receive the container 30 and the stabilizer rails 54. The moveable aperture plates are supported by aperture guides 92 which are suitably fastened to the clear polycarbonate wall 84 of the outer enclosure by suitable fasteners 94. It should be appreciated that if a container of a different size than that shown in FIG. 4 is to be filled, the aperture plates 90 may be removed and other suitable aperture plates may be substituted therefor. In the preferred design of this invention aperture plates are provided only on the outer enclosure. However, if the heat loss is unacceptable when aperture plates are provided only on the outer enclosure, it may be desirable to add similar aperture plates to the inner enclosure.

The front of each of the enclosures is closed by a suitable door. Thus, the inner enclosure is closed by a suitable door 96, and the outer enclosure is closed by a suitable outer door indicated generally at 98. As can best be seen from FIG. 1, the outer door is formed of a rectangular frame 100, having lower and upper horizontal frame members 100.1, 100.2 respectively, and left and right vertically extending frame members 100.3 and 100.4 respectively. A sheet of clear polycarbonate 102 is mounted within the frame 100 via a glazing strip 104 and a silicone seal 106. The door 98 is hinged to the left front vertical frame member via a piano hinge 108, the hinge 108 being secured to the vertically extending frames 74 and 100.3 by conventional fasteners not shown. The outer door can be opened by engaging a door knob 110 mounted on the right vertical frame member 100.4. A suitable mechanical latch (not illustrated) may be provided for holding the outer door in its closed position. When the door is closed it will abut a stop not shown.

Figure 6:
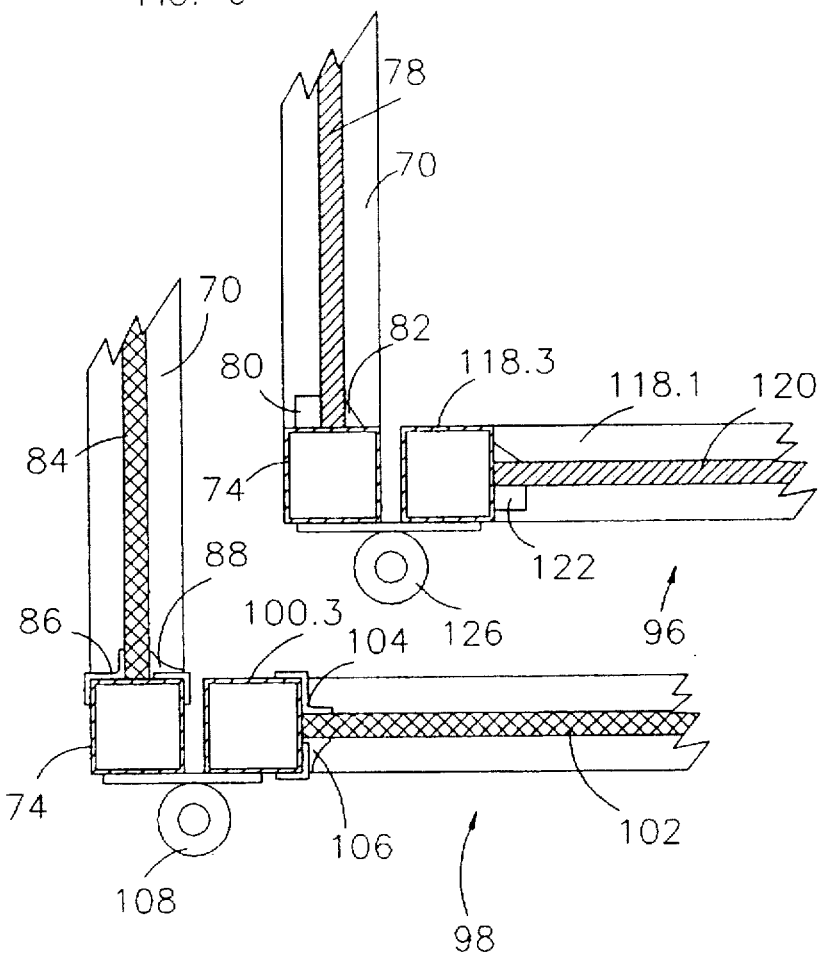
FIGS. 6 and 7 are further sectional views, these views being taken generally along the lines 6—6 and 7—7 in FIG. 1.
Figure 7:
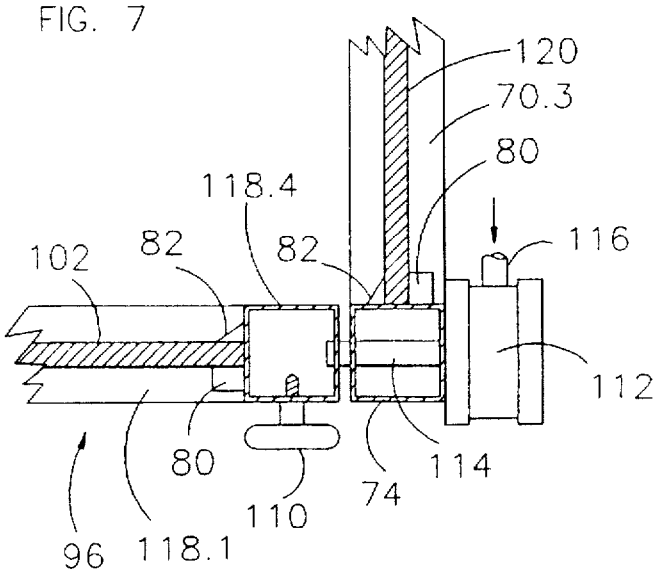
Figure 8:
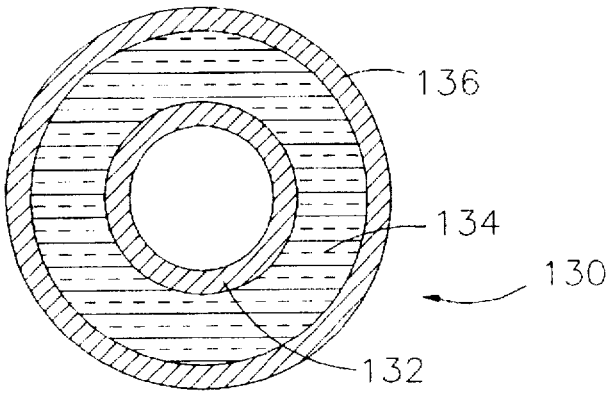
FIG. 8 is a sectional view taken generally along the line 8—8 in FIG. 1.

With reference now to FIGS. 1 and 6, the inner door is formed in essentially the same manner as the outer door. Thus, there is an inner door frame 118 having a lower horizontal frame member 118.1, an upper horizontal frame member 118.2, a left vertical frame member 118.3, and a right vertical frame member 118.4. Tempered glass 120 is mounted within the door frame 118 and is secured in place via a glazing strip 122 and a silicone seal 124. This door is also hinged by a piano hinge 126 to the left vertical frame member 74 of the inner enclosure 64. A door knob 128 is provided for opening and closing the inner door. In order to hold the door 96 in its locked position, an air operated door interlock is provided, the interlock being indicated at 112. The interlock has a latch 114 which, when extended to the left as viewed in FIG. 7, will enter a suitable aperture within the door frame 118.4 to hold it in its latched position. The air operated door interlock is operated via pressurized factory air which is suitably controlled in a manner to be set forth below. However, it should be noted that when air under pressure is introduced into the interlock 112 via air tube 116 that the latch 114 will be extended to the left as shown in FIG. 7. When the air pressure is removed a spring (not shown) will return the latch to its normal right hand position where the door is free to open.

Figure 10:
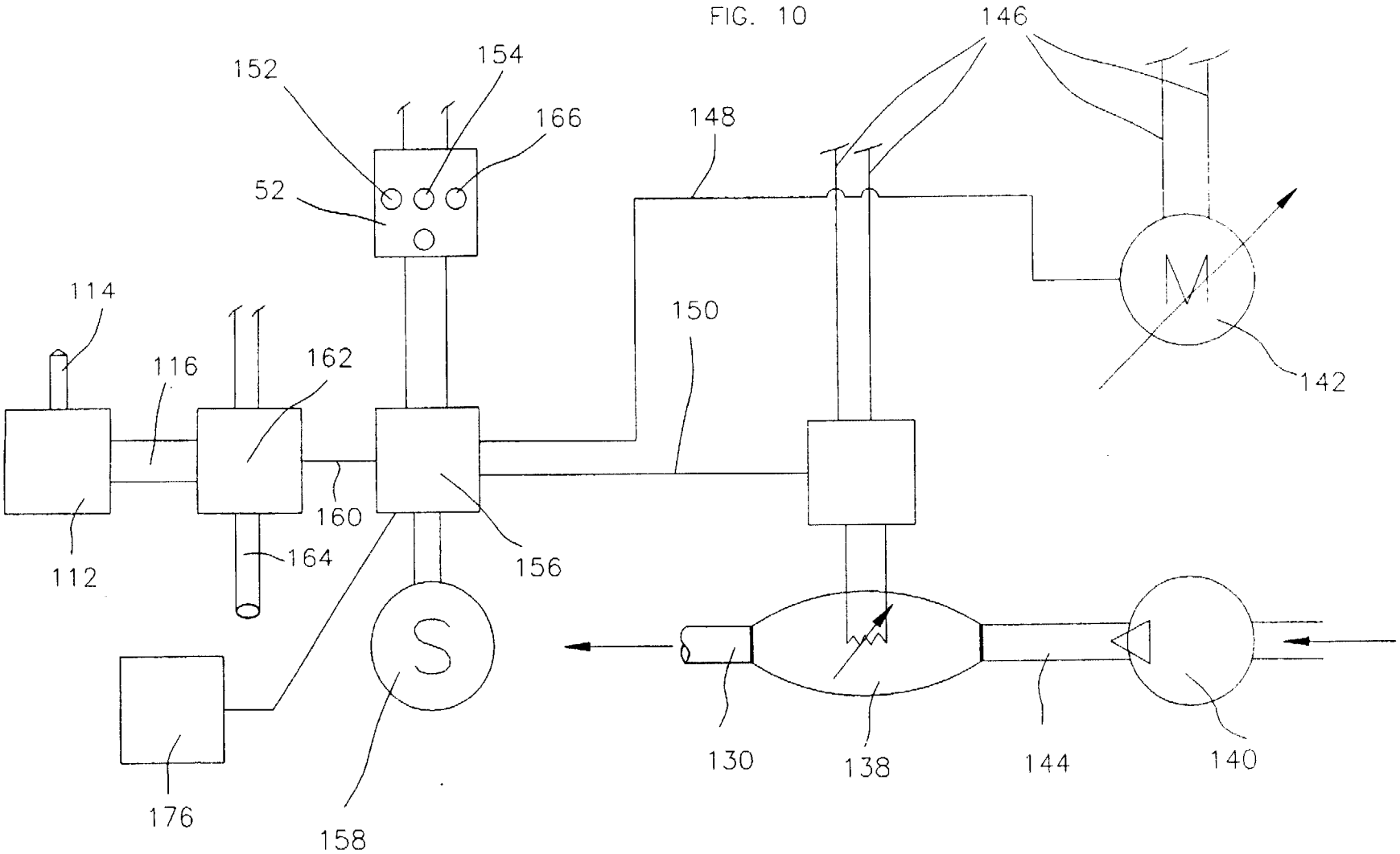
FIG. 10 is a schematic view illustrating the controls of the embodiment shown in FIGS. 1–9.

In order to heat the product within the product reservoir 14 as well as the filling nozzles and other components within the enclosure 64 hot air is introduced into the inner enclosure 64 by a hot air duct indicated generally at 130. The hot air duct extends from the enclosures to a heater located outside of the enclosure. The hot air duct is well insulated, and to this end it is formed of an inner silicone duct 132 which is in turn wrapped with a ceramic fiber batting 134, the batting and inner duct in turn being received within a silicone outer duct 136. It has been found that with this design of a heating duct that a heater may be located outside of the enclosure at a distance of 25 feet or more. This is desirable when filling containers with highly flammable materials. The heater is indicated schematically at 138 in FIG. 10 and includes a variable output electric heater with a maximum output 10,000 watts. Air is blown over the heater 138 by a blower indicated schematically at 140. (The air received by the blower may be suitably filtered.) The blower is in turn driven by a variable speed electric motor 142. The heater 138 is preferably mounted within a tubular cartridge 144, the upstream end of which is connected to the discharge end of the blower 140, and the downstream end of the tubular cartridge being in turn connected to the hot air duct 130. The heater 138 and motor 140 are both connected via power lines 146 to a suitable source of electric current. The rotational speed of the motor 142 is controlled by control signals carried by control line 148 and the output of the variable output electric heater is controlled by control signals carried by control line 150.

In operation, the operator of the machine will dial in the temperature that is necessary to be maintained for the proper operation of the filling machine. For example, if dealing with a material which is highly viscous at room temperature, it will be necessary to dial in the proper temperature where the material will properly flow though the flow control means to the container. Thus, it may be desirable to maintain the enclosure at 80° C. which temperature will be dialed in by the operator. Once the proper temperature has been established, the operator will initiate operation by pushing the start button 154. When the start button is pushed, the control mechanism 156 will send signals through the motor control line and heater control line to cause the heater to be operated at full output and the motor to be operated at a speed to most quickly heat the enclosure. A sensor 158 is mounted within the enclosure and when a suitable operating temperature has been achieved it will be sensed by the control mechanism 156 which will in turn send further control signals through the motor control line 148 and heater control line 150 to adjust their outputs to the most efficient operation. In the meantime the operation of the conveyor belt will be initiated to bring containers into the machine so that they can be suitably filled and discharged. An interlock will prevent operation of the conveyor if the inner enclosure is not at the desired temperature. The control mechanism will also send a signal through a control line 160 to a valve 162 which is connected to factory air indicated by tube 164, the valve normally being closed, but being opened when the temperature within the enclosure at the location of the sensor reaches a certain level which is considered dangerous to the operator. Air will then flow through the air line 116 to the air operated interlock 112 to cause the latch 114 to be extended. It should be noted that if the air temperature within the enclosure varies that through the sensor 158 and suitable controls that the thermal output of the heater 138 may be varied so as to adequately maintain a relatively constant temperature within the enclosure. This is a desirable feature in order to maintain proper operating efficiencies. In addition, by employing the double walled enclosure with the air barrier between the walls a very energy efficient system has been developed.

At the completion of the operation, the operator will stop the operation by hitting the stop button 166. This will immediately turn off the heater and increase the speed of the blower to its maximum rated output to quickly cool down the enclosure. Once the enclosure has been suitably cooled down, it may be possible to open the door as the latch 114 will become disengaged from the door.

It should be noted that it has been found that it is necessary to direct the hot air received within the enclosure. Thus, the hot air duct is connected to a fitting 168 within the inner enclosure 64. The fitting is in turn is provided with suitable air jets 170. In order to prevent excessive heat transfer away from the pump 22, one of the air jets is connected to an air tube 172 which is directed directly at the pump 22.

Figure 9:
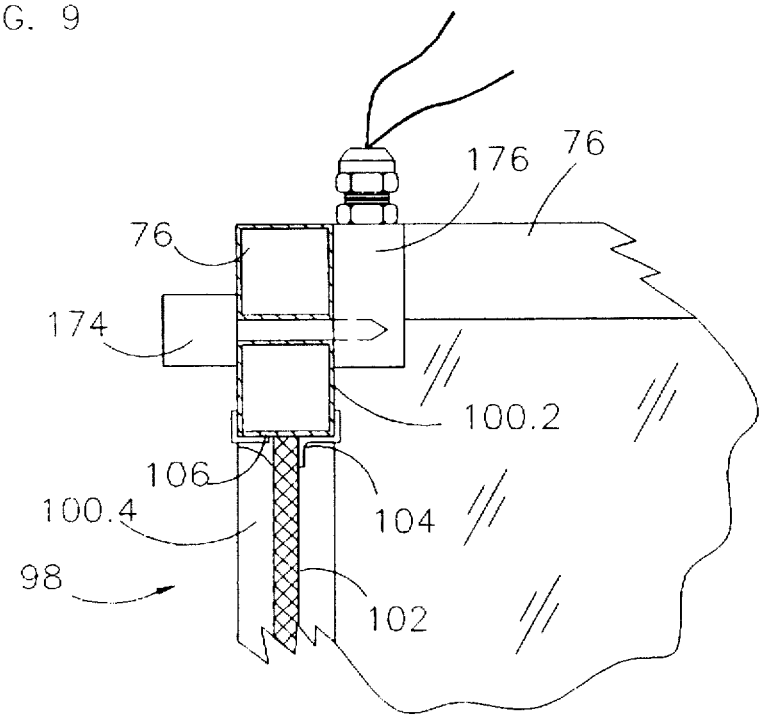
FIG. 9 is a view similar to FIG. 7 but showing an embodiment of an electrical cabinet door interlock switch and key, this view being taken generally along the line 9—9 in FIG. 3.

In the design described above the inner door 96 can only be opened when the temperature within the inner enclosure 64 is below a predetermined temperature at which time the air operated door interlock latch 114 is withdrawn to permit the opening of the door. In some situations the temperature within the enclosure is not sufficiently high to be dangerous to the operator in which case the door interlock may be omitted. However, in all cases it is desirable to use an electrical door interlock which is illustrated at the top left hand corner of FIG. 2 and in FIG. 9. In this design an electrical door interlock key 174 is provided which, when in its locking position, will engage an electrical door interlock switch 176. When the key 174 is removed to permit opening of the door 98, the electrical door interlock switch 176 will send a signal to the controller 156 to shut down the heater and run the blower on high until the enclosure temperature is reduced.

It should be apparent to one having ordinary skill in the art that by the employment of the foregoing design the objects of this invention have been achieved. While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure, wherein the heating means includes a hot air heater disposed outside of the enclosure, and a hot air duct which interconnects the heater with the enclosure, wherein the hot air duct is formed of two concentric silicone tubes which are separated from each other by ceramic fiber insulation material.

2. The liquid filling machine as set forth in claim 1 wherein a blower is provided which drives air through the heater and into the hot air duct.

3. The liquid filling machine as set forth in claim 2 wherein the enclosure is provided with a temperature sensor which transmits a signal which is proportional to the temperature in the enclosure, wherein the heater has a variable thermal output, and wherein the output of the heater and the blower are controlled in response to the temperature sensor signal.

4. The liquid filling machine as set forth in claim 1 wherein the hot air duct is connected to air jets within the enclosure.

5. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure, wherein the heating means includes a hot air heater disposed outside of the enclosure, and a hot air duct which interconnects the heater with the enclosure, wherein the hot air duct is connected to air jets within the enclosure, wherein the means to control the flow of product from the reservoir to the filling nozzle is a pump mounted within the enclosure and a motor mounted outside of the enclosure, and wherein one of the air jets within the enclosure is directed at the pump.

6. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, wherein the inner wall of the enclosure is formed of tempered glass and the outer wall is formed of a clear plastic, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure.

7. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure, wherein at least one of the enclosures is provided with adjustable shutters where the upper flight of the conveyor enters and leaves the enclosure so that air loss may be minimized.

8. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure, wherein the enclosure is provided with a temperature sensor which transmits a signal which is proportional to the temperature in the enclosure, and wherein the inner and outer enclosure walls are provided with adjacent doors, the inner door being provided with a pneumatic lock which will be locked in response to a signal received from the temperature sensor when the temperature exceeds a predetermined level.

9. A liquid filling machine for filling containers with materials which are either solid at room temperatures or highly viscous; the filling machine comprising:

a product reservoir;

a filling nozzle;

flow control means for controlling the flow of product from the reservoir to the nozzle;

an enclosure about the product reservoir and the filling nozzle, the sides of the enclosure being formed of spaced apart inner and outer walls, there being a trapped air space between the inner and outer walls to provide insulation so that heat loss from the enclosure will be minimized, at least a portion of the side walls being formed of a clear material so that the filling operation within the enclosure cam be observed;

an endless conveyor having upper and lower flights, which upper flight supports containers to be filled via the filling nozzle, the upper flight entering and exiting the enclosure; and heating means for heating the enclosure, wherein the heating means includes a heater disposed outside of the enclosure and a hot air duct which interconnects the heater with the enclosure, wherein a variable speed blower is provided which drives air through the heater and into the hot air duct, wherein the enclosure is provided with a temperature sensor which transmits a signal which is proportional to the temperature in the enclosure, wherein the inner and outer enclosure walls are provided with adjacent doors, and wherein heater output control means are provided responsive to the opening of the outer door for shutting down the heater and causing the variable speed blower to be driven at a high speed to cool down the enclosure until it is below a predetermined temperature.

* * * * *